US006539584B1

(12) United States Patent
Gillotti

(10) Patent No.: US 6,539,584 B1
(45) Date of Patent: Apr. 1, 2003

(54) SELF-LOCKING HINGE

(76) Inventor: Michael Gillotti, 800 Blessing Way, Sebastopol, CA (US) 95472

( * ) Notice: Subject to any disclaimer, the term of this patent is extended or adjusted under 35 U.S.C. 154(b) by 0 days.

(21) Appl. No.: 10/004,203

(22) Filed: Nov. 1, 2001

(51) Int. Cl.[7] ..... E05D 11/06

(52) U.S. Cl. ..... 16/371; 16/374; 16/327; 16/324; 16/326; 16/334; 16/252

(58) Field of Search ..... 16/371, 354, 374, 16/366, 327, 321–324, 326, 334, 252; 297/216.12, 391, 216.15, 216.17, 400, 403, 408; 5/99.1, 98.2, 93.1, 93.2; 403/91, 92, 99–102, 94

(56) References Cited

U.S. PATENT DOCUMENTS 4,614,454 A * 9/1986 Kassai ..... 403/62
5,058,239 A * 10/1991 Lee ..... 16/324
5,377,368 A * 1/1995 Cheng ..... 5/99.1
5,483,710 A * 1/1996 Chan ..... 5/99.1
5,530,977 A * 7/1996 Wang ..... 5/99.1
5,542,151 A * 8/1996 Stranski et al. ..... 16/326
5,617,592 A * 4/1997 Cheng ..... 5/99.1
5,761,755 A * 6/1998 Huang ..... 5/99.1
5,791,804 A * 8/1998 Cheng ..... 403/97
5,909,653 A * 6/1999 Imura et al. ..... 455/575
5,918,347 A * 7/1999 Morawetz ..... 16/322
6,092,334 A * 7/2000 Kim ..... 49/8

* cited by examiner

*Primary Examiner*—Chuck Mah
(74) *Attorney, Agent, or Firm*—Jack Lo

(57) ABSTRACT

A self-locking hinge is comprised of a housing with spaced side walls, and a cogged wheel positioned between the side walls. A pair of slots are respectively positioned on the interior surfaces of the side walls. A stop is connected between the side walls in alignment with the slots. An axle positioned through a center of the cogged wheel has opposite ends positioned in the slots. The cogged wheel is secured in position when it is biased against the stop by springs positioned in the slots and engaged against the ends of the axle. The cogged wheel is pivotable when it is pushed away from the stop against the springs, and is automatically biased against the stop and secured in position when it is released.

7 Claims, 4 Drawing Sheets

SELF-LOCKING HINGE

BACKGROUND OF THE INVENTION

1. Field of the Invention

This invention relates generally to hinges.

2. Prior Art

A typical lockable hinge is comprised of two members jointed by a threaded pivot extending through the abutting surfaces between the members. A nut on the pivot is tightened or loosened to fix the members in position or allow the members to rotate. The ability of the members to stay in position when under stress depends on the compression applied to the abutting surfaces by the nut on the pivot. The nut must be turned very tightly to hold the members in position, so tightly that turning it by hand may be painful. Since the hinge relies only on the friction between the abutting surfaces to stay in position, it is unable to withstand much stress before it is forced out of position.

OBJECTS OF THE INVENTION

The objects of the present self-locking hinge are to be automatically locked in any selected position, to stay in position even under great stress, and to be easily and painlessly adjustable. Further object of the present invention will become apparent from a consideration of the drawings and description.

BRIEF SUMMARY OF THE INVENTION

A self-locking hinge is comprised of a housing with spaced side walls, and a cogged wheel positioned between the side walls. A pair of slots are respectively positioned on the interior surfaces of the side walls. A stop is connected between the side walls in alignment with the slots. An axle positioned through a center of the cogged wheel has opposite ends positioned in the slots. The cogged wheel is secured in position when it is biased against the stop by springs positioned in the slots and engaged against the ends of the axle. The cogged wheel is pivotable when it is pushed away from the stop against the springs, and is automatically biased against the stop and secured in position when it is released.

DRAWING REFERENCE NUMERALS

10. Hinge
11. Housing
12. Side Wall
13. Connector
14. Female Member

15. Male Member
16. Cogged Wheel
17. Cog
18. Notch
19. Slot
20. Stop
21. Axle
22. Spring
23. First Arm
24. Double Hinge
25. Massage Table
26. Headrest
27. Second Arm
28. Frame
29. Sleeve
30. Tab
31. Slot
32. Pivot Pin
33. Stop Pin
34. First Hole

DETAILED DESCRIPTION OF THE INVENTION

Figure 1:
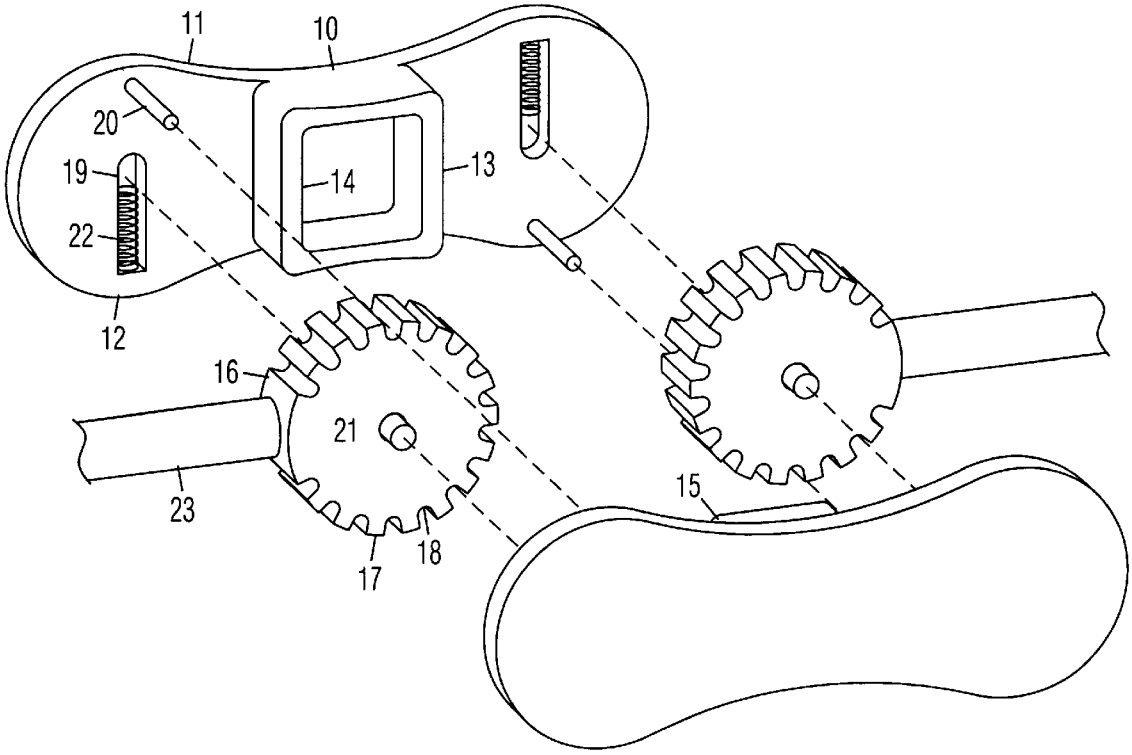
FIG. 1 is an exploded view of the present self-locking hinge.

FIGS. 1–2:

A preferred embodiment of a self-locking hinge 10 is shown in a side perspective exploded view in FIG. 1. In this example, a double hinge is shown wherein a second hinge 10' is attached to hinge 10 which comprises a first hinge. Any number of such hinges may be attached together, or second hinge 10' may be eliminated. Second hinge 10' is identical to first hinge 10, but is preferably mirrored to first hinge 10 about a longitudinal axis. Only first hinge 10 is described in detail below.

Hinge 10 is comprised of a housing 11 with spaced side walls 12 fixed in spaced relation by a connector 13. Connector 13 is preferably comprised of a female member 14 integrally attached to an inner side of one side wall, and a male member 15 integrally connected to an inner side of the other side wall and arranged to be fitted inside female member 14. Alternatively, connector 13 may be separate from side walls 12, and may be attached by any method, such as with a fastener, an adhesive, etc.

A cogged wheel 16 with cogs 17 and notches 18 is positioned between side walls 12. Cogged wheel 17 may have any number of cogs and notches. A pair of slots 19 with closed ends are respectively positioned on the interior surfaces of side walls 12. A stop 20 is connected between side walls 12 in alignment with slots 19. Stop 20 is preferably comprised of a bar as shown, but it may be comprised of separate projections respectively attached to side walls 12. An axle 21 positioned through a center of cogged wheel 16 has opposite ends positioned in slots 19. Cogged wheel 16 is biased against stop 20 by springs 22 respectively positioned in slots 19 and engaged against the ends of axle 21. In this example, springs 22 are comprised of compression springs positioned on a side of axle 21 opposite from stop 20. Alternatively, springs 22 may be comprised of extension springs positioned on the same side of axle 21 as stop 20. Other spring arrangements may be provided, such as a leaf spring. A first arm 23 is attached to cogged wheel 16.

Figure 2:
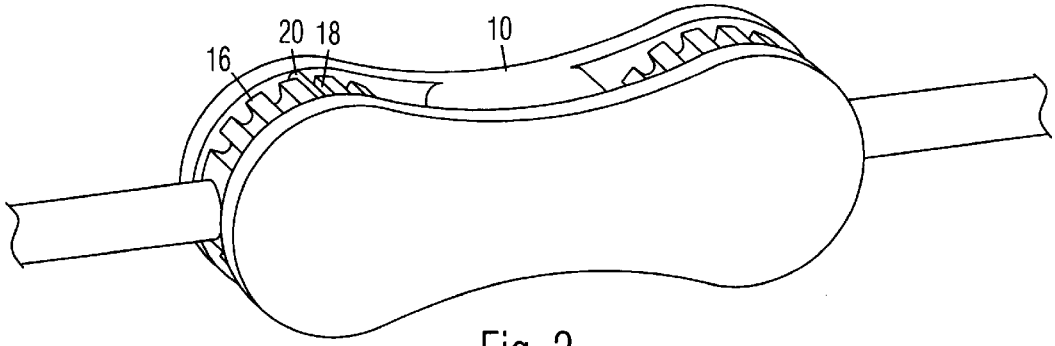
FIG. 2 is a side perspective view of the hinge assembled.

Hinge 10 is shown assembled in FIG. 2. Cogged wheel 16 is biased against stop 20 by the springs, wherein stop 20 is positioned securely in a notch 18. Cogged wheel 16 is thus securely locked in position, and is capable of withstanding great stress without moving.

Figure 3:
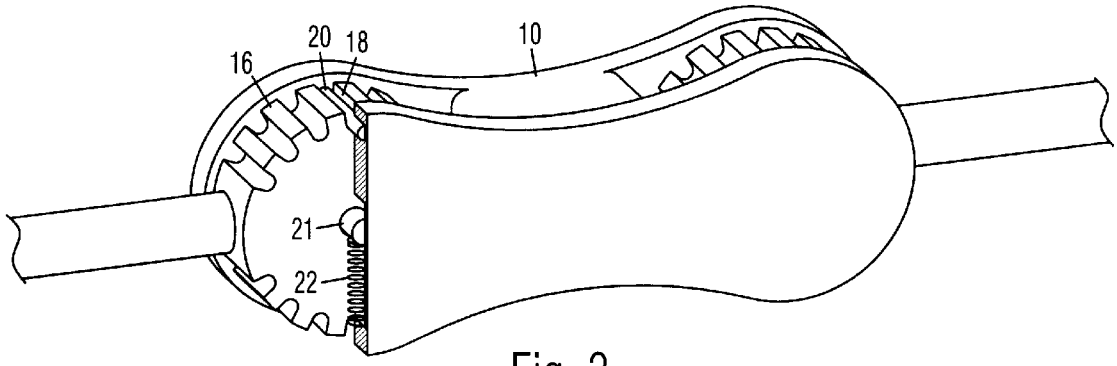
FIG. 3 is a side perspective cutaway view of the hinge.

FIGS. 3–6:

Hinge 10 is shown assembled in FIGS. 3–6, and with the closer wall partially cut away to illustrate its operation. In FIG. 3, cogged wheel 16 is biased against stop 20 by springs 22, wherein stop 20 is positioned securely in a notch 18.

Figure 4:
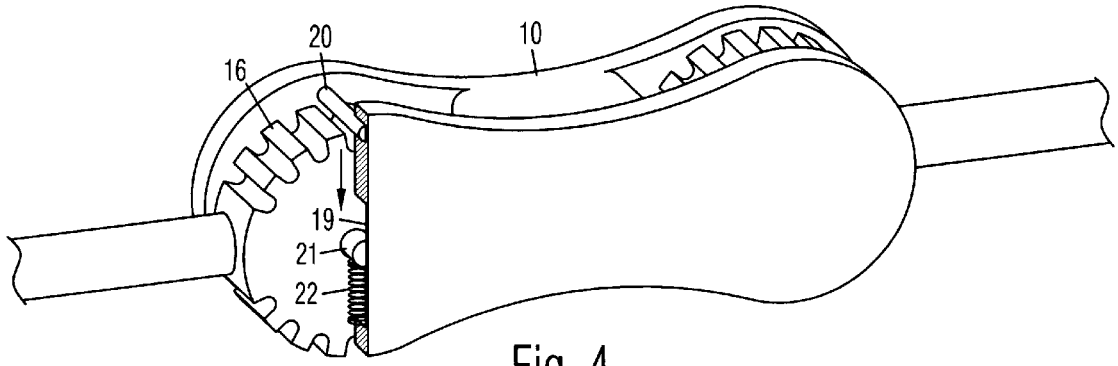
FIG. 4 is a side perspective cutaway view of the hinge in a first step of being pivoted.
Figure 5:
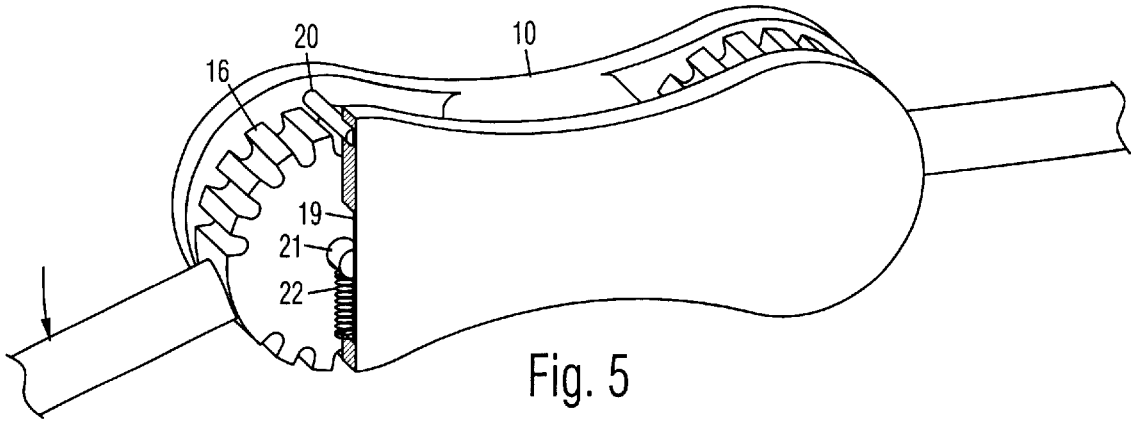
FIG. 5 is a side perspective cutaway view of the hinge in a second step of being pivoted.

Cogged wheel 16 may be rotated by dislocating it from stop 20, and letting it reengage with stop 20. As shown in FIG. 4, cogged wheel 16 is dislocated from stop 20 by pushing cogged wheel 16 away from stop 20 against springs 22. Cogged wheel 16 is movable painlessly with little effort. The opposite ends of axle 21 are guided by slots 19 to move linearly. After cogged wheel 16 is dislocated from stop 20, cogged wheel 16 is free to rotate about axle 21 to another position, as shown in FIG. 5.

Figure 6:
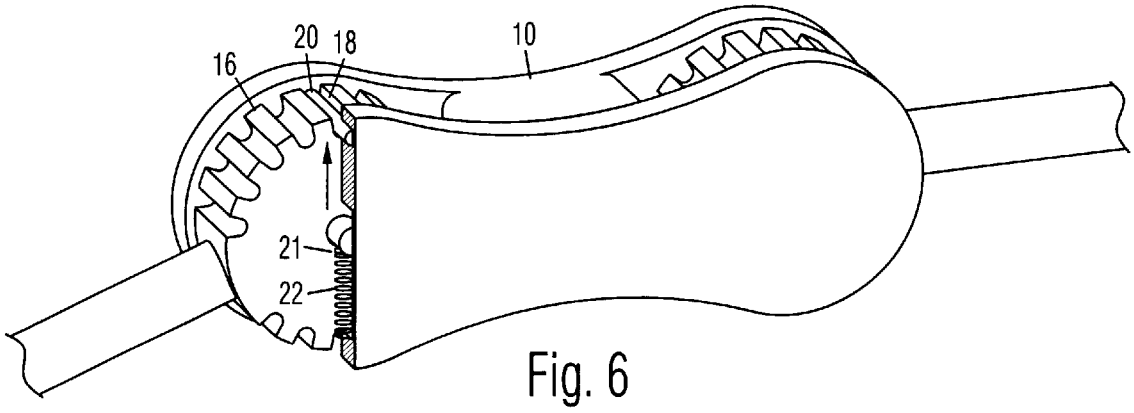
FIG. 6 is a side perspective cutaway view of the hinge in a third step of being pivoted.

When provided as a double hinge as shown, having the first and second hinges arranged in longitudinally mirrored positions prevent the other wheel from being dislocated unintentionally when one wheel is being adjusted. When cogged wheel 16 is rotated to a desired new position, it is released to let springs 22 bias it against stop 20, as shown in FIG. 6. Cogged wheel 16 is thus securely locked in a new position.

Figure 7:
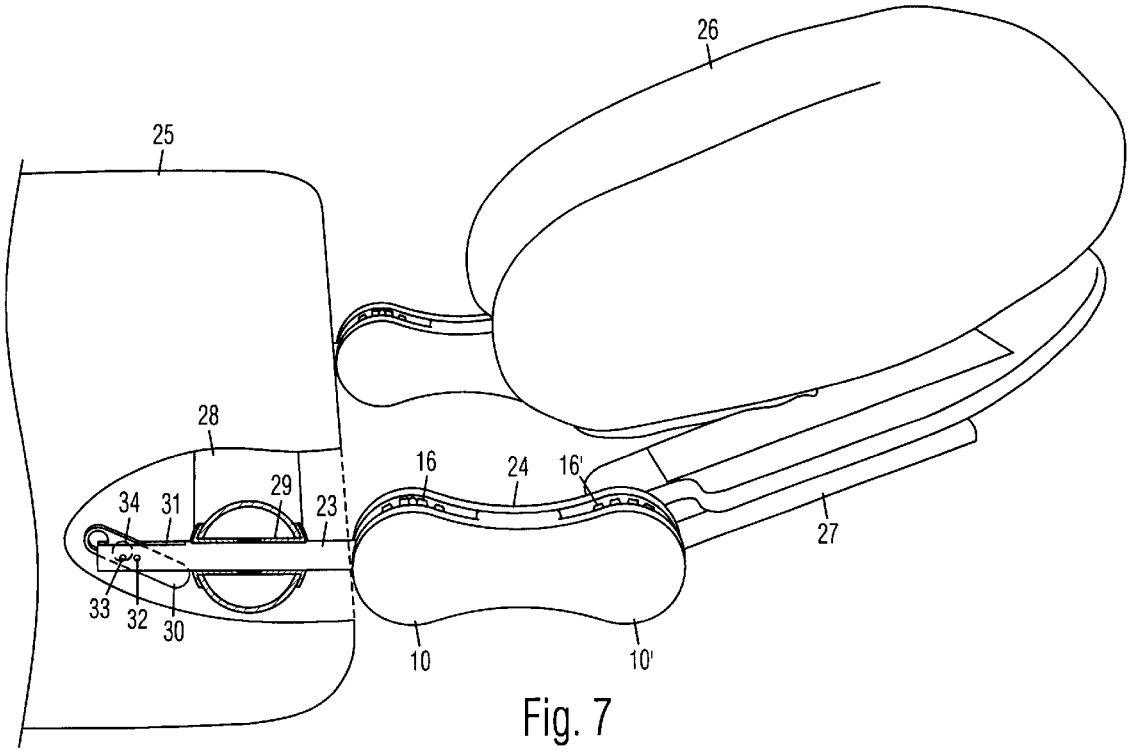
FIG. 7 is a side perspective view of the hinge connecting a massage table and a headrest.

FIG. 7:

The present hinge may be used to connect any two members which may rotate relative to each other. As an example, a pair of double hinges 24 are shown in FIG. 7 connected between a massage table 25 and an adjustable headrest 26. First arms 23 are respectively attached to cogged wheels 16 in first hinges 10, and second arms 27 are attached to cogged wheels 16' in second hinges 10'. Headrest 26 is supported on second arms 27, and may be pivoted to many different positions by rotating hinges 10 and 10'.

First arm 23 is inserted transversely through a frame 28 under massage table. A tubular sleeve 29 is positioned through frame 28 for supporting first arm 23. A locking tab 30 is hinged within a slot 31 at a distal end of first arm 23 by a pivot pin 32. Tab 30 is pivotable between a retracted position aligned with first arm 23, and an extended position slightly angled relative to first arm 23. The angle of tab 30 when extended is limited by a stop pin 33 forward of pivot pin 32 and extending loosely through a first hole 34 in tab 30. The inner end of tab 30 is biased to pivot down, such as by having the inner end heavier than the outer end.

First arm 23 is inserted through frame 28 by pushing up inner end of tab 30 to align tab 30 with first arm 23. After tab 30 has passed completely through frame 28, the inner end of tab 30 is automatically dropped to lock first arm 23 in position. First arm 23 may be removed from frame 28 by pushing up the inner end of tab 30.

Although the foregoing description is specific, it should not be considered as a limitation on the scope of the invention, but only as an example of the preferred embodiment. Many variations are possible within the teachings of the invention. For example, different attachment methods, fasteners, materials, dimensions, etc. can be used unless specifically indicated otherwise. The relative positions of the elements can vary, and the shapes of the elements can vary. Therefore, the scope of the invention should be determined by the appended claims and their legal equivalents, not by the examples given.

I claim:

1. A self-locking hinge for connecting a first member to a second member, comprising:

a housing with spaced apart side walls connected together by a connector, wherein said housing is arranged for connecting to said first member;

a cogged wheel positioned between said side walls for connecting to said second member, wherein said cogged wheel is comprised of alternating cogs and notches;

a pair of slots positioned on respective interior surfaces of said side walls;

a stop positioned between said side walls generally in alignment with said slots;

an axle positioned through said cogged wheel, wherein opposite ends of said axle are respectively positioned in said slots; and a spring biasing said cogged wheel against said stop so that said stop is positioned in one of said notches;

wherein said cogged wheel is rotatable when said cogged wheel is pushed away from said stop, and said hinge cogged wheel is locked when said cogged wheel is allowed to automatically reengage with said stop.

2. The self-locking hinge of claim 1, wherein said spring is comprised of a coiled spring positioned in one of said slots and engaged between one end of said axle and a closed end of said one of said slots.

3. A self-locking double hinge for connecting first and second members, comprising:

first and second hinges which are connected together and respectively arranged for attaching to said first and second members, wherein each of said hinges is comprised of:

a housing with spaced apart side walls connected together by a connector;

a cogged wheel positioned between said side walls for connecting to a respective member, wherein said cogged wheel is comprised of alternating cogs and notches;

a pair of slots positioned on respective interior surfaces of said side walls;

a stop positioned between said side walls generally in alignment with said slots;

an axle positioned through said cogged wheel, wherein opposite ends of said axle are respectively positioned in said slots; and, a spring biasing said cogged wheel against said stop so that said stop is positioned in one of said notches;

wherein said cogged wheel is rotatable when said cogged wheel is pushed away from said stop, and said cogged wheel is locked when said cogged wheel is released and allowed to automatically reengage with said stop;

wherein said first and second hinges are mirrored about a longitudinal axis of said housing, so that when said cogged wheel in one of said hinges is pushed, said cogged wheel in the other hinge is maintained in a locked position.

4. The self-locking hinge of claim 3, wherein said spring is comprised of a coiled spring positioned in one of said slots and engaged between one end of said axle and a closed end of said one of said slots.

5. A self-locking double hinge, comprising:

first and second hinges which are connected together, wherein each of said hinges is comprised of:

a housing with spaced apart side walls connected together by a connector, wherein said housing is arranged for connecting to said first member;

a cogged wheel positioned between said side walls for connecting to said second member, wherein said cogged wheel is comprised of alternating cogs and notches;

a pair of slots positioned on respective interior surfaces of said side walls;

a stop positioned between said side walls generally in alignment with said slots;

an axle positioned through said cogged wheel, wherein opposite ends of said axle are respectively positioned in said slots; and a spring biasing said cogged wheel against said stop so that said stop is positioned in one of said notches;

wherein said cogged wheel is rotatable when said cogged wheel is pushed away from said stop, and said cogged wheel is locked when said cogged wheel is released and allowed to automatically reengage with said stop;

said double hinge further including:

a first arm connected to said cogged wheel of said first hinge; and a locking tab hinged within a slot at a distal end of said first arm, wherein said tab is pivotable between a retracted position aligned with said first arm, and an extended position projecting from and angled relative to said first arm, said first arm is arranged for being inserted into a hole in a frame member when said tab is aligned with said first arm, and locked in said frame member when said tab is angled relative to said first arm.

6. The self-locking hinge of claim 5, wherein said spring is comprised of a coiled spring positioned in one of said slots and engaged between one end of said axle and a closed end of said one of said slots.

7. The self-locking hinge of claim 5, further including a headrest connected to said cogged wheel of said second hinge.

* * * * *